United States Patent [19]

Rensch

[11] 4,430,834

[45] Feb. 14, 1984

[54] BUILDING CONSTRUCTION SYSTEM

[76] Inventor: Eberhard G. Rensch, 1, Sentier des Roses, CH - 1820 Montreux, Switzerland

[21] Appl. No.: 265,586

[22] Filed: May 20, 1981

[30] Foreign Application Priority Data

May 24, 1980 [DE] Fed. Rep. of Germany ..... 3020048
Apr. 29, 1981 [DE] Fed. Rep. of Germany ..... 3116993

[51] Int. Cl.[3] ..... E04B 5/00

[52] U.S. Cl. ..... 52/281; 52/481; 52/483; 52/489; 52/770

[58] Field of Search ..... 52/731, 481, 483, 489, 52/770, 775, 281, 282

[56] References Cited

U.S. PATENT DOCUMENTS

| | | | |
|---|---|---|---|
| 3,537,219 | 1/1970 | Navarre | 52/489 |
| 4,016,690 | 4/1977 | Richardson | 52/82 |
| 4,086,739 | 5/1978 | Hall | 52/775 |
| 4,312,158 | 1/1982 | Teli | 52/281 |

FOREIGN PATENT DOCUMENTS

| | | | |
|---|---|---|---|
| 2421742 | 11/1975 | Fed. Rep. of Germany | 52/731 |
| 2917480 | 11/1980 | Fed. Rep. of Germany | 52/282 |
| 2376927 | 9/1978 | France | 52/775 |

*Primary Examiner*—Henry E. Raduazo
*Attorney, Agent, or Firm*—Karl F. Ross; Herbert Dubno

[57] ABSTRACT

A building construction assembly has a plurality of vertical posts and horizontal members each formed of a plurality of parallel shell elements and each having on at least one face a pair of flat laterally projecting flanges. The flanges lie generally in a plane and define an opening. Wall panels are secured to these flanges, which are integral with the respective shell elements, by means of C-shaped clips each having one arm engaging the flange in one direction and another arm engaging the panel and pressing it in the opposite direction against the flange. The flanges may be bent back double and received in resilient channels.

8 Claims, 29 Drawing Figures

41
41a
42a
42b
42c
42d
42e
15a
17a
17b

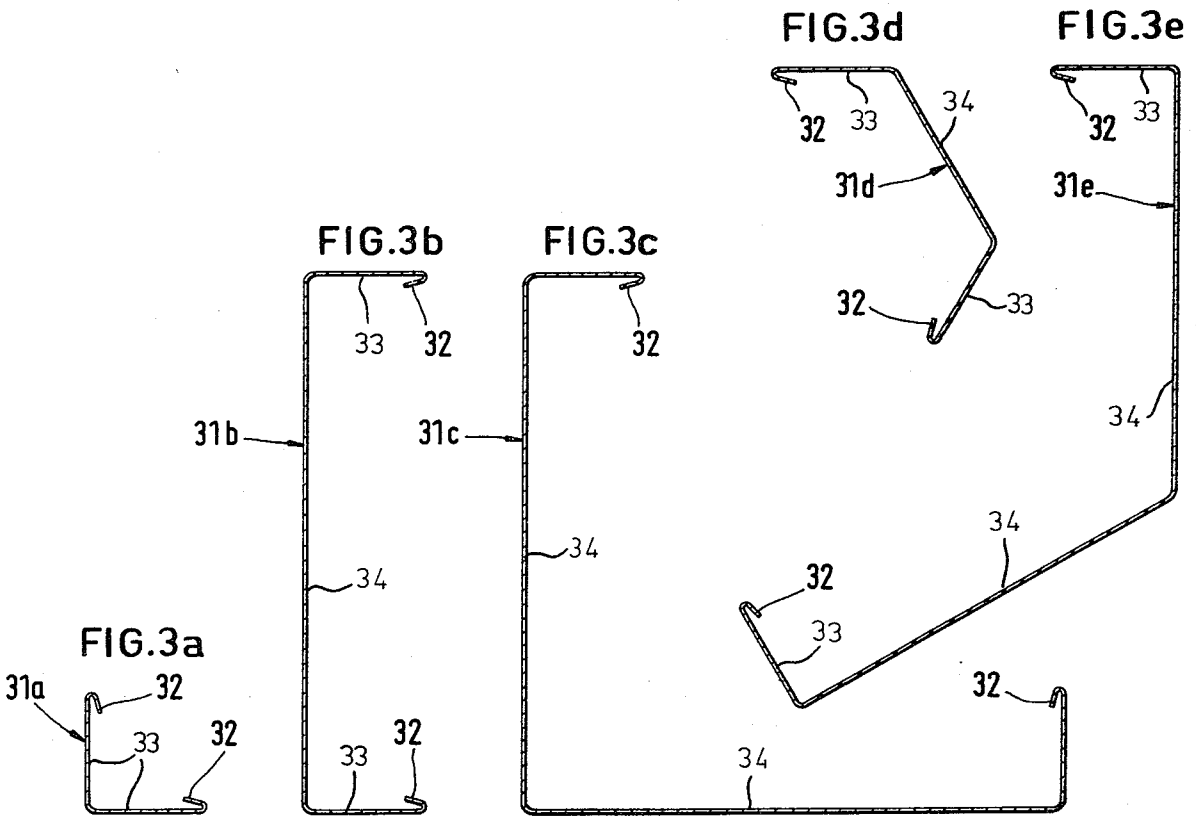
FIG.3e
FIG.3d
FIG.3c
FIG.3b
FIG.3a
31a
31b
31c
31d
31e
32
33
34
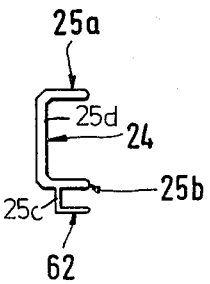
FIG. 2
25a
25b
25c
25d
24
62

BUILDING CONSTRUCTION SYSTEM

FIELD OF THE INVENTION

The present invention relates to a building construction system of the so-called shell or cavity type. More particularly this invention concerns construction elements usable for building cavity wall, floor, and ceiling partitions.

BACKGROUND OF THE INVENTION

The old system of construction using vertical posts—studs—and horizontal members—sill plates and top plates—to the faces of which wall panels are nailed or screwed has been replaced with systems which allow the panels be be mounted within the outlines of the posts and horizontal members, in order to save valuable space. A typical such system, as described in German published patent application No. 2,223,457, has posts and horizontal members formed with longitudinal grooves in which flat mounting strips are seated once the posts and horizontal members are fixed in place, with their grooves end-to-end and coplanar. The wall panels are then screwed to the mounting strips or secured by means of appropriate moldings. Such an arrangement is particularly handy in modular construction.

This system is never sturdy enough to support large heavy panels. When greatly stressed the mounting strips can be pushed out of their grooves, so that the panel becomes disattached. Obviously, this is extremely dangerous, so such a system has only found use only in relatively light-duty and normally temporary construction.

OBJECTS OF THE INVENTION

It is therefore an object of the present invention to provide an improved building construction system.

Another object is the provision of improved construction elements that allow the above-described type of construction to be used even with relatively heavy panels.

SUMMARY OF THE INVENTION

These objects are attained according to the instant invention in an arrangement wherein the posts and horizontal members have flat laterally projecting flanges that lie generally in a plane and that form an opening. The wall, panel—here intended to cover also ceiling and floor panels—is secured to these flanges by means of clips each having one arm engaging and bearing in one direction perpendicular to the plane on the panel and another arm engaging and bearing in the opposite direction on one of the flanges. Thus these clips secure the panel solidly to the flanges.

The flanges according to the instant invention are integral with the posts and horizontal members so that very heavy panels can be clipped to them safely. These flanges may be the edges of profiled shell elements that form the horizontal members and posts. The instant invention proposes a whole series of such shell elements which can be combined to form virtually any type of horizontal or vertical member of virtually any desired cross section. Normally two such flanges, which are parallel to each other, are provided on each such member for making a standard cavity wall.

More particularly according to this invention the appropriate shell elements are combined to form a post or horizontal member of the desired cross section, with two parallel flanges extending from each post or member face from which a partition is to extend. The wall panels that will form the cavity wall are clipped to the parallel flanges and insulation is provided between the panels.

To this end each of the shell elements has an outer flange which extends perpendicular to the respective face, an inner lip extending parallel to the respective face from the outer edge of the respective outer flange, and an outer lip extending perpendicular to the respective face back toward the element from the outer edge of the respective inner lip. Each such outer flange with the respective inner and outer lips is received in a respective channel formed of resilient material so that the wall panel clipped to it will be tight. A double channel can be provided for the cavity-wall arrangement described immediately above.

The clips according to this invention are of C-section and are each formed with a notch opening parallel to and adjacent the surface of the respective wall panel. Cover plates have overturned edges receivable in these notches so that each cover plate can overlie a respective shell element for a neat appearance. These cover plates are snapped in place, once again without the use of screw or nail fasteners, for extremely easy construction. The shell elements and cover plates form excellent raceways suitable for wiring, although normally the hollow interior of the posts at least is filled with insulation.

It is possible according to this invention to bolt two such shell elements to the opposite sides of a board to form an extremely strong and even load-bearing structural element. Otherwise structural elements can be incorporated in the system according to the invention, with the shell elements secured to, for instance, a girder or the like.

DESCRIPTION OF THE DRAWING

The above and other objects, features, and advantages will become more apparent from the following, in which reference is made to the accompanying drawing wherein:

FIG. 2 is an end view of a clip according to the invention;

FIGS. 3*a*–3*e* are end views of cover plates usable with the support members of the instant invention;

SPECIFIC DESCRIPTION

Figures 1A, 1B, 1C, 1D, 1E:
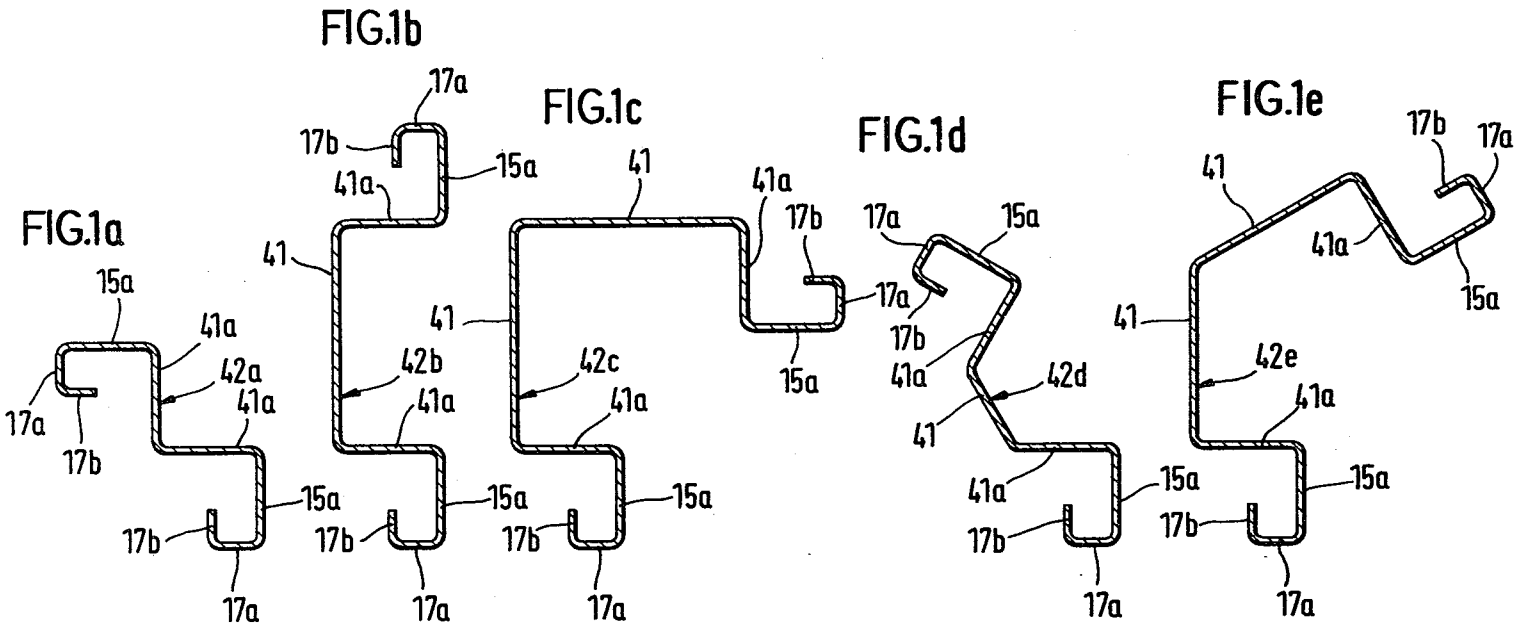
FIGS. 1*a*–1*e* are end views of shell elements for constructing horizontal and vertical support members according to this invention.

As seen in FIG. 1*a* a shell element 42*a* according to this invention is of regular cross section, normally being made of metal by extrusion or bending. It has a pair of planar outer portions 41*a* which extend at a right angle to each other and from which edge flanges 15*a* extend also at right angles. Inner lips 17*a* extend at right angles from the edge flanges 15*a*, extending back parallel to the respective outer portions 41*a*, and outer lips 17*b* extend at right angles from the inner lips 15*a*, extending back parallel to the respective edge flanges 15*a*.

The shell element 42*b* of FIG. 1*b* has a planar inner portion 41 between its inner portions, but is otherwise identical to the element 42*a* of FIG. 1*a*.

In FIG. 1*c* the shell element 42*c* has two main portions 41 at a right angle to each other, but is otherwise identical to the element 42*b* of FIG. 1*b*.

The shell element 42*d* of FIG. 1*d* has a single main portion 41 from which the two outer portions 41*a* extend at an obtuse angle, but otherwise the structure is identical to the other elements.

Finally the shell element 42*e* of FIG. 1*e* has a pair of main portions 41 lying at an obtuse angle to each other, but otherwise is identical to the arrangement of FIG. 1*c*.

FIG. 2 shows a generally U-shaped clip 24 having a pair of arms 25*a* and 25*b* extending parallel to each other from a flat bight 25*d*. A short L-shaped arm 25*c* extends from the arm 25*b* and forms a groove or notch 62 whose function will be described below.

FIG. 3*a* shows a cover plate 31*a* generally of L-section and having a pair of flanges 33 with turned-over outer edges 32 which are intended to fit into the notch 62.

The cover plate 31*b* of FIG. 3*b* is generally C-shaped, having a wide central portion 34 from which the two flanges 33 project.

The plate 31*c* of FIG. 3*c* has two main portions 34 extending at a right angle to each other and having flanges 33 extending at right angles from their outer edges.

In FIG. 3*d* the plate 31*d* has two flanges 33 extending at obtuse angles from the central section 34.

The plate 31*e* of FIG. 3*e* has two main portions 34 extending at an obtuse angle to each other.

Figure 4:
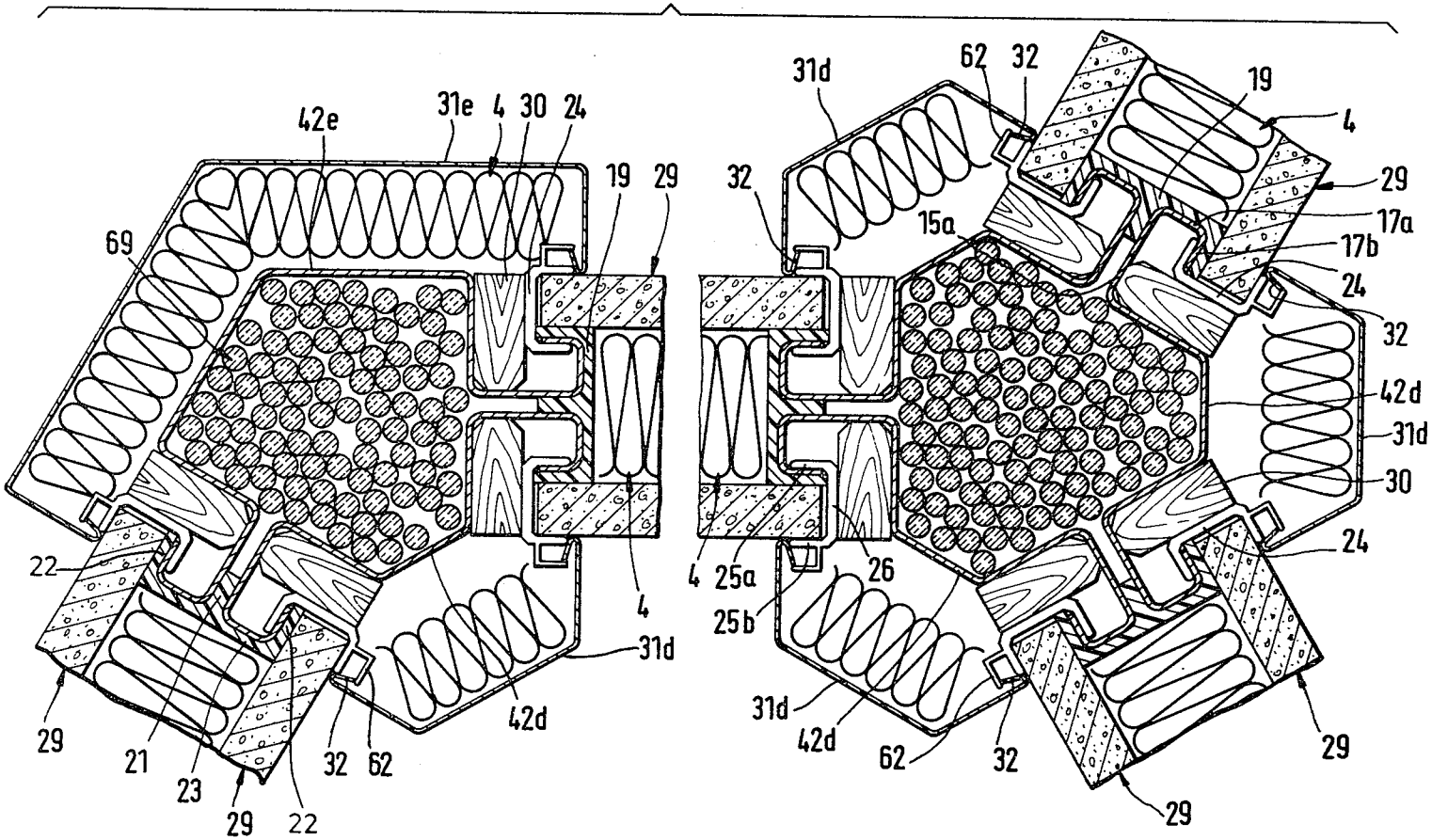
FIG. 4 is a horizontal section through two posts and the intervening wall according to the invention.

FIG. 4 shows on the left a five-sided post formed of one element 42*d* and one element 42*e*. The interior of the pentagonal-section post thus formed is filled with loose insulation 69 for acoustic and thermal insulation. The edge flanges 15*a* and inner and outer lips 17*a* and 17*b* are received between the center flange 21 and outer flange 23 of a W-section double channel 19. Wall panels 29 lie against the outer faces of the outer beam flanges 22. The clips 24 in turn are engaged around the outer beam flanges 22, outer lips 17*b*, and wall panels 29, with the one arm 25*a* engaging the inner face of the outer lip 17*b* and the outer arm 25*b* engaging the outer face of the panel 29. This makes it possible to secure cover plate 31*d* and 31*e* over the post sides corresponding to the shell elements 42*d* and 42*e* respectively. Spacer blocks 30 which are useful for nailing are provided between the clips 24 and the outer portions of the shell elements. Insulation 4 is provided under the cover plates also to lessen the transmission of noise and heat.

Figure 12:
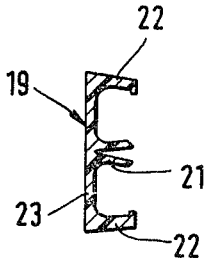
FIG. 12 is a cross section through a beam used with the system of this invention.

The double channel 19 is made of a moisture-resistant and elastically deformable material such as rubber or a synthetic-resin elastomer. As seen in FIG. 12 its center flange 21 is split and normally these two sides are pushed together by the edge flanges 15*a*. The elements 31*a–e* and 42*a–e* are made of metal, either bent steel plate or extruded aluminum. The clips 24 may be made of metal or of an appropriate synthetic resin. The system is normally assembled by first fitting together the shell elements with the double channels 19, then securing the panels 29 in place with the clips 24, and finally driving in the spacer blocks or boards 30. In fact the entire arrangement can usually be built virtually without nails or screws, yet will hold together very strongly.

The right-hand post shown in FIG. 4 uses three shell elements 42*d* with respective cover plates 31*d* so that three cavity-wall partitions with insulation 4 can extend from it. In all other respects this post assembly is identical to that on the left-hand side of FIG. 4.

Figure 5:
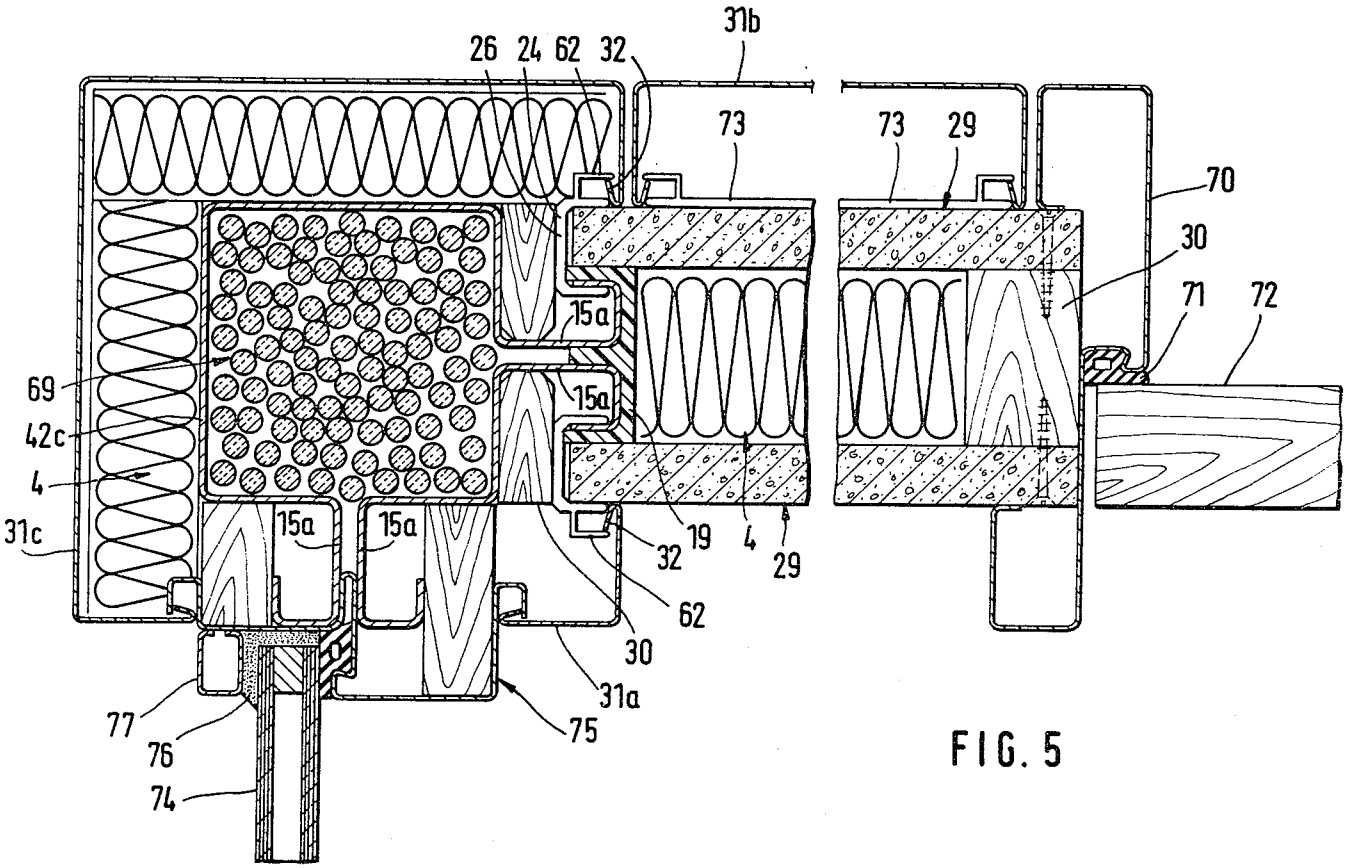
FIG. 5 is a horizontal section through a corner-post assembly according to the invention.

FIG. 5 shows a corner post formed of one of the shell elements 42*c* with a cover plate 31*c* and a shell element 42*a* with a cover 31*a*, constructed in substantially the same manner shown in and described with reference to FIG. 4. On one side of the corner post there is provided a window frame 75 holding a thermal-pane window 74 having an elastomeric bedding 76 and an outside trim strip 77. On the other side of the corner post another standard cavity wall is provided, but covered on its outside with the cover plate 31*b* whose bent-over edges 32 are secured in notches 62 formed on a flat retainer strip 73 secured flatly to the face of the outer wall panel 29. The other ends of these wall panels 29 are screwed to the opposite sides of another stud or spacer block 30 carrying a door stop 70 with weatherstripping 71 for a door 72.

Figure 6:
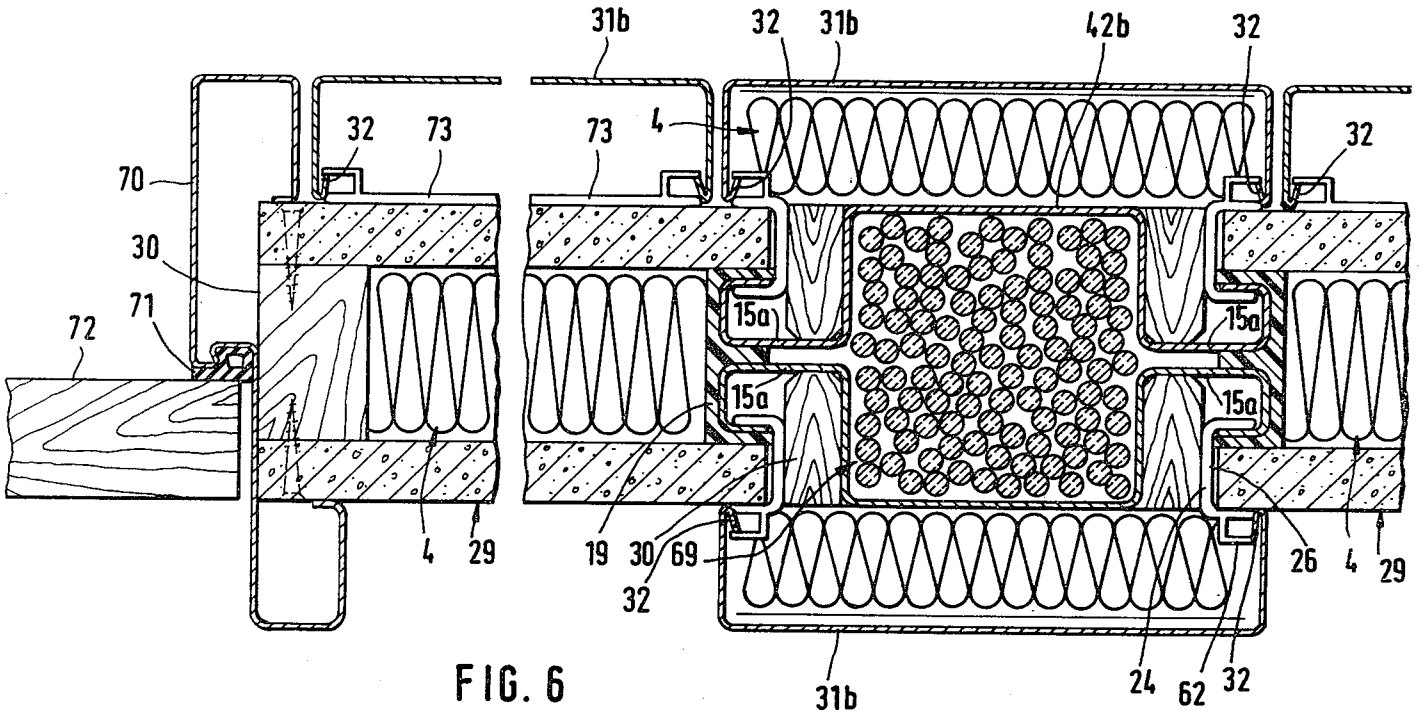
FIG. 6 is a horizontal section through a construction assembly connected to the end of the assembly of FIG. 5.

In FIG. 6 the other half of the door 72 can be seen. Otherwise this figure shows structure which is functionally and structurally identical to other structure described in considerable detail above and needing no further elucidation here.

Figure 7:
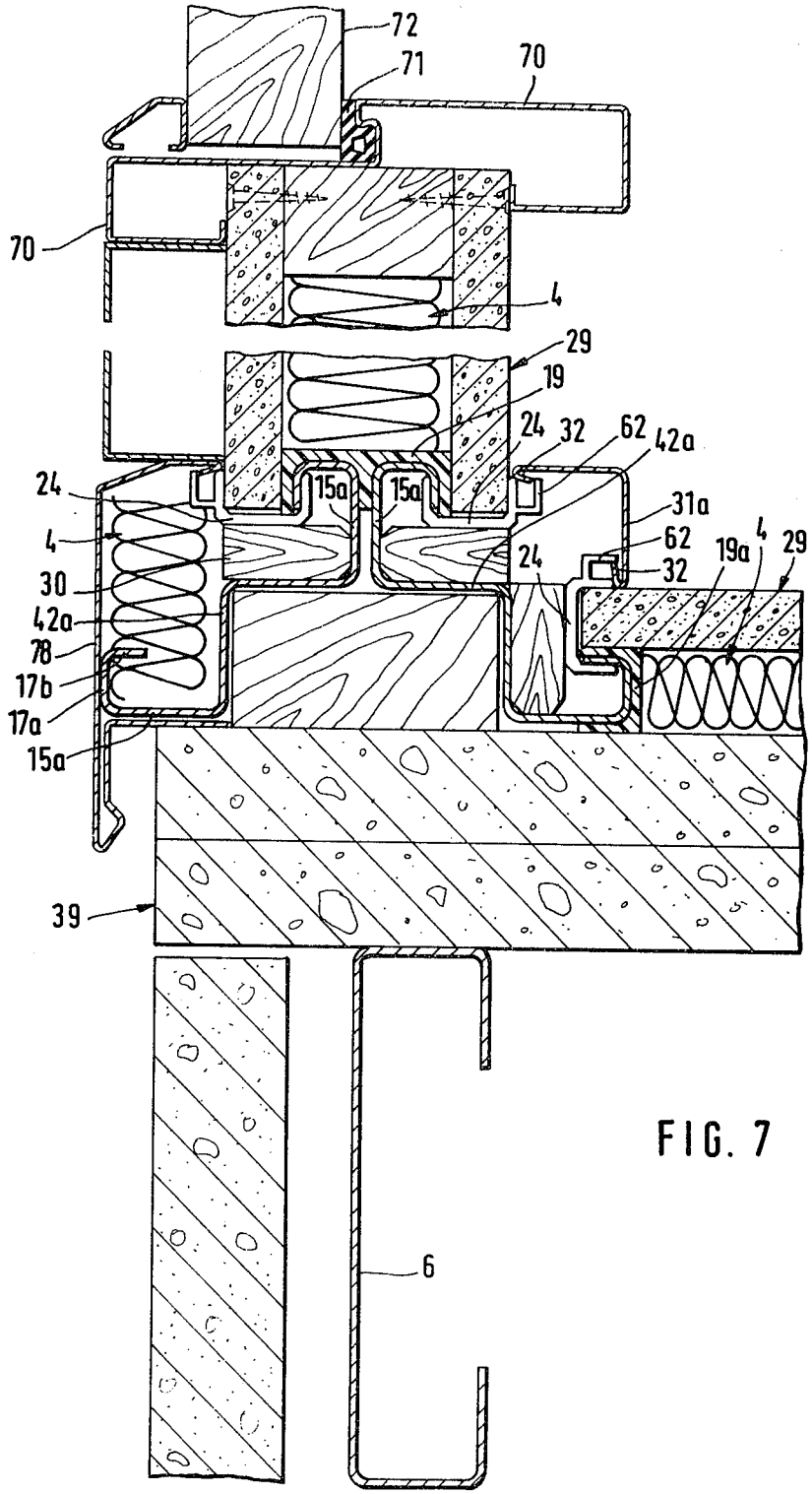
FIGS. 7 and 8 are vertical sections through the construction assembly according to this invention at floor level.

FIG. 7 shows the use of the construction assembly in a horizontal construction member, here as a sill plate. A single channel 19*a* is here employed under the panel 29 serving as flooring or subflooring, but otherwise most of the structure shown is identical to that described above. On the outside a special outside wall plate 70 is employed which has a drip edge 70′ so that water cannot enter above the floor 39 that is supported on an appropriate load-bearing C-girder 6. The door 72 is visible at the top of FIG. 7.

Figure 8:
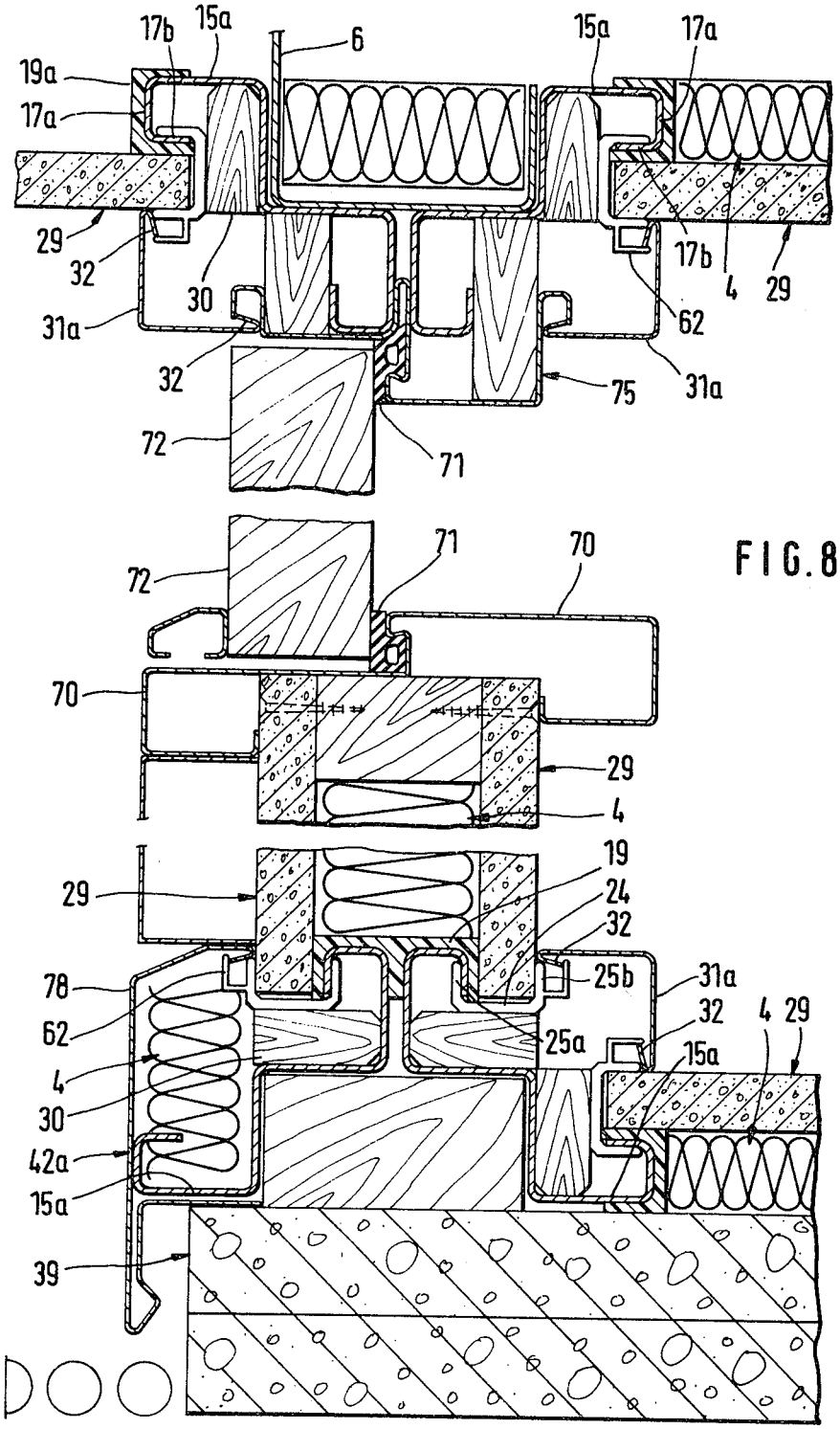
Figure 9:
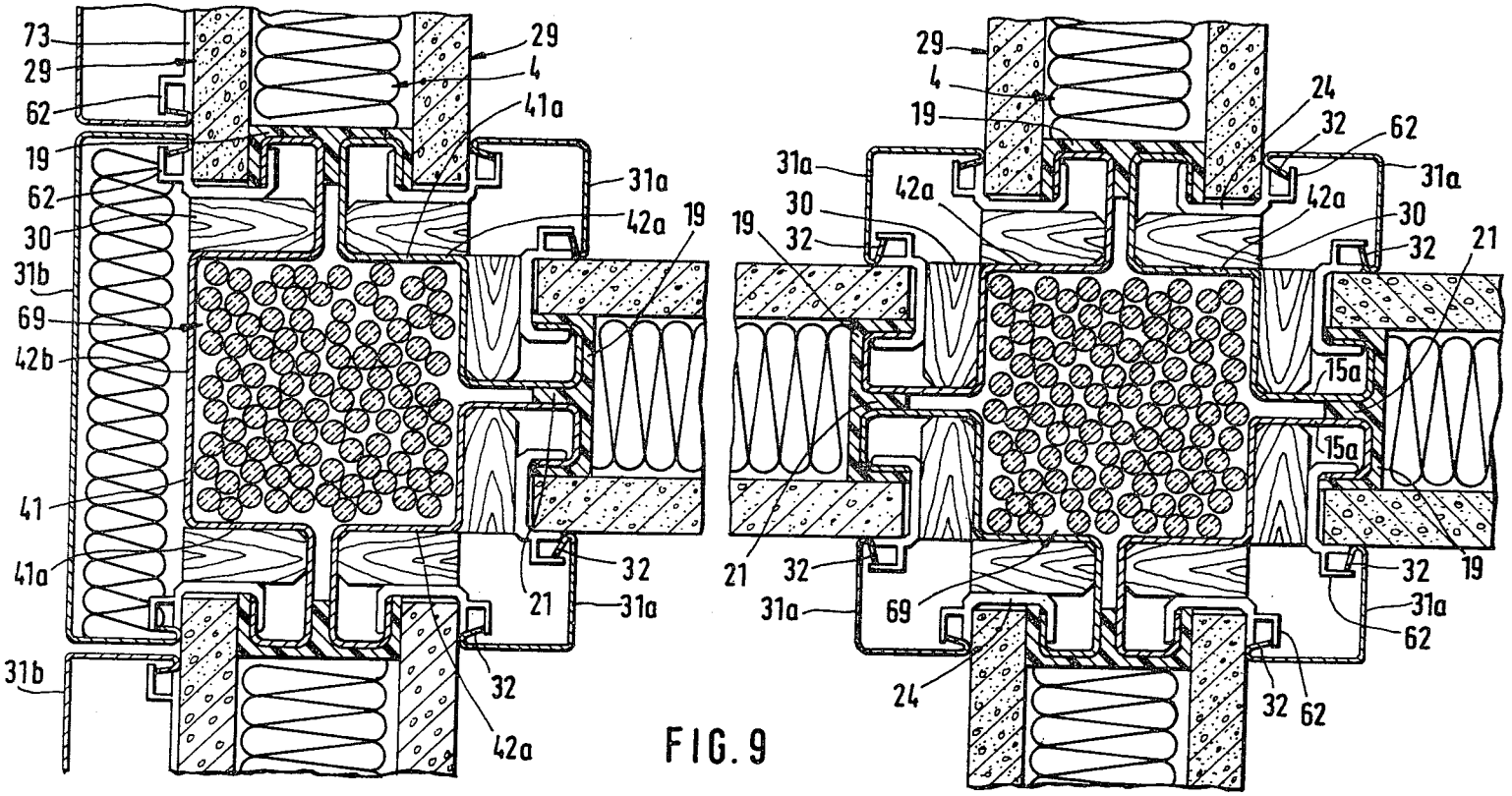
FIG. 9 is a horizontal section through two post assemblies according to the invention.

In FIG. 8 another floor assembly is shown, but one over a slab rather than a supported floor 39. Furthermore this figure shows a header assembly built around another structural C-girder 6 at the top of the door 72. All other structure shown in this figure is identical to that described in some detail above.

Figure 10:
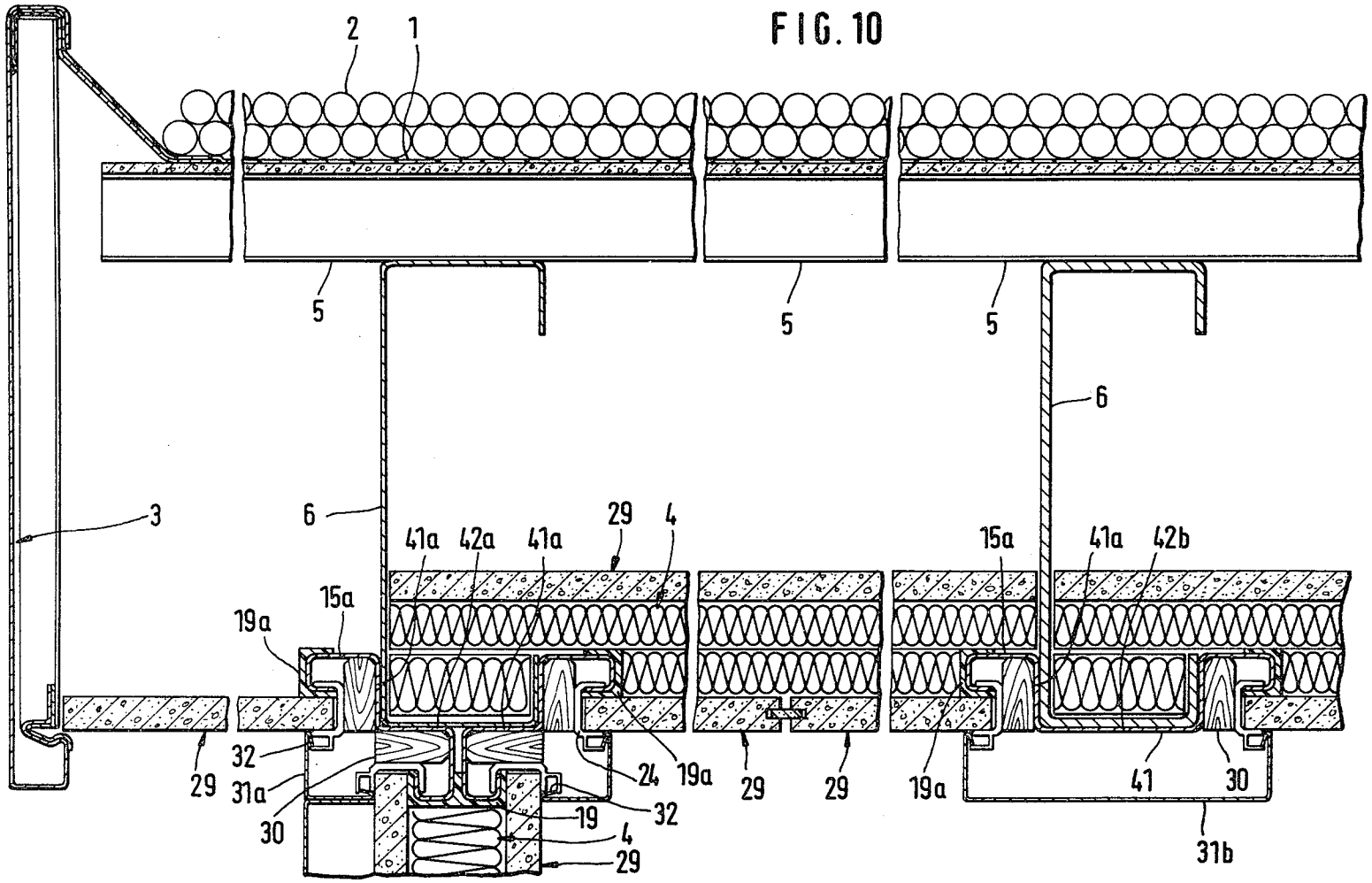
FIG. 10 is a vertical section through a construction assembly according to this invention at roof level.

FIG. 10 merely shows a pair of corner or intersection posts formed as shown in the above-described arrangements. The system according to this invention is, obviously, very versatile and lends itself to any standard style of construction. The variously shaped elements shown in FIGS. 1*a–e* and 2*a–e* are representative of the types of construction elements which the person according to the instant invention can employ.

Figure 11:
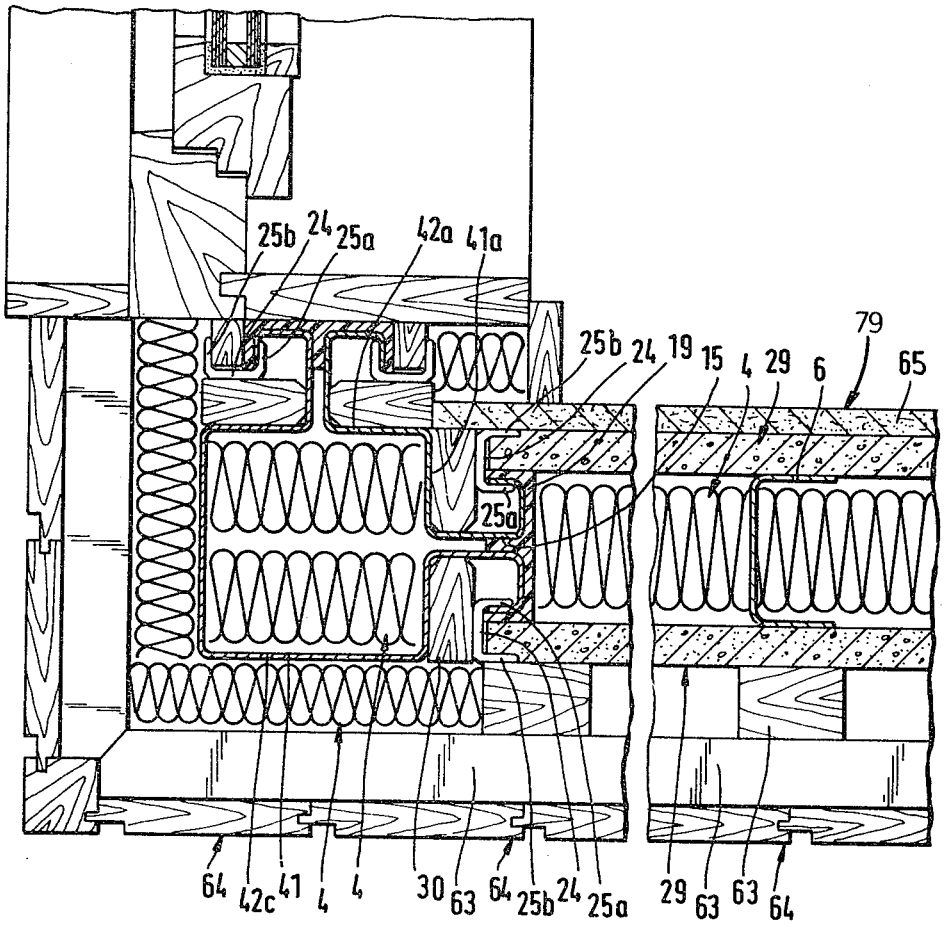
FIG. 11 is a horizontal section through a construction assembly of the invention at an outside corner.

FIG. 11 shows the use of the the construction assembly according to the instant invention in a roof. Here a plurality of C-girders 6 have their lower ends seated in shell elements 42*b* which are bolted to these girders 6 and support roof beams 5 carrying a roofing skin 1 covered with gravel 2. A roof edging 3 of standard construction surrounds the roof.

The system according to the instant invention can be used with wood siding, as shown in the corner post of FIG. 11. Crosswise wood strapping 63 is provided secured to the outer panel 29 and siding boards 64 are in turn nailed to this strapping. A structural C-girder 6 is ingegrated in the structure, whose inner surface can have a plaster layer 65 covered with paint 79. Otherwise the same reference numerals as used in the other above-discussed figures are used in FIG. 11 for functionally and structurally identical elements.

Figure 13:
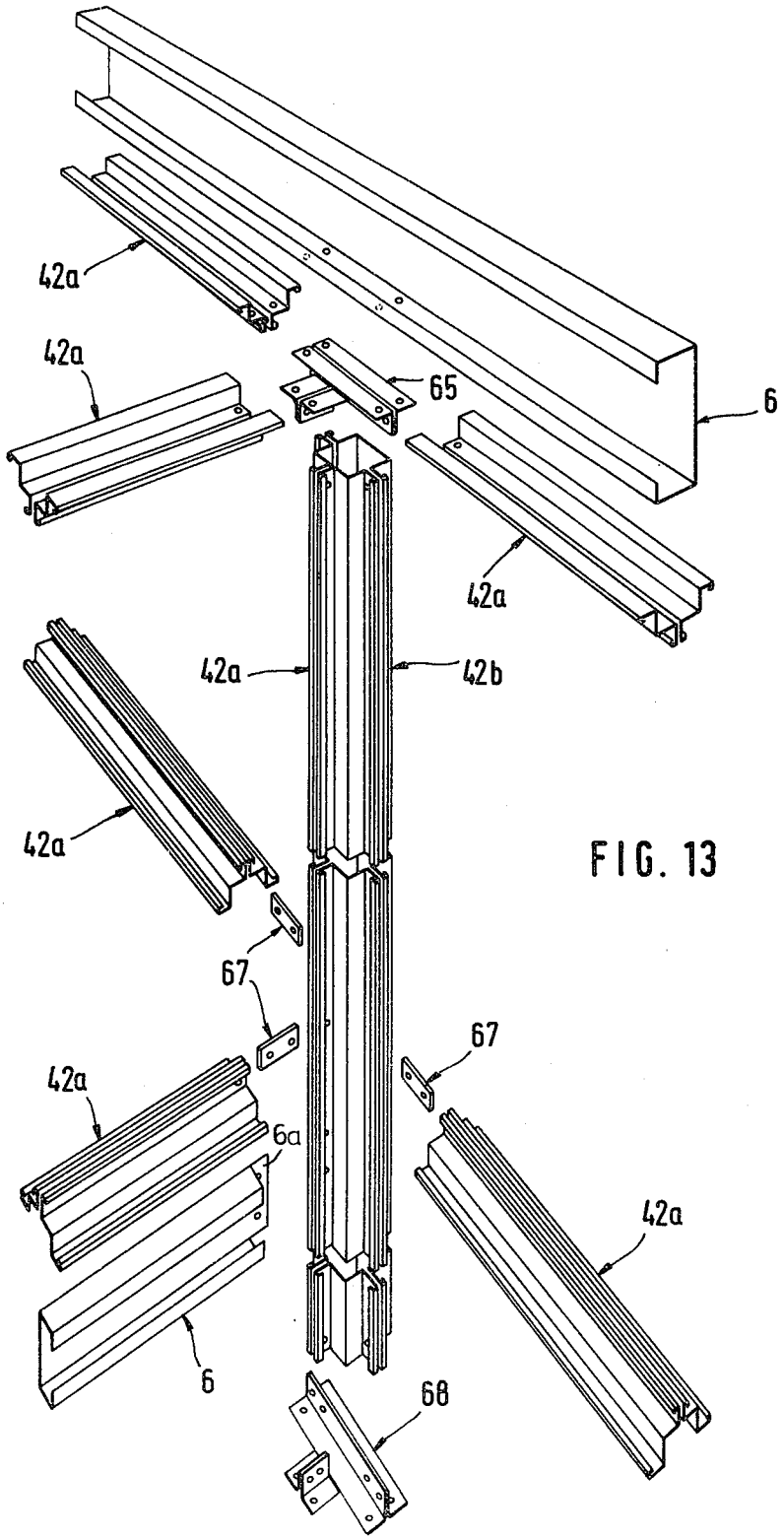
FIG. 13 is an exploded perspective view of the system of this invention.

FIG. 13 shows how the various shell elements and girders according to the instant invention are fixed together. The girder 6 can be fastened between two elements 42*a* and 42*b* by bolting its web 6*a* between them. Fastening plates 67 can be employed to secure horizontal shell elements between the flanges of the vertical ones, and stiffening tees 68 and 65 are respectively provided at the bottom and top of the post formed by the elements 42*a* and 42*b* to secure the horizontal members to them. The profiled section of the shell elements according to this invention gives them great strength, especially when mounted together as described. An extremely rigid building skeleton or frame can be made with the system according to this invention using standard pieces.

Figures 14, 15:
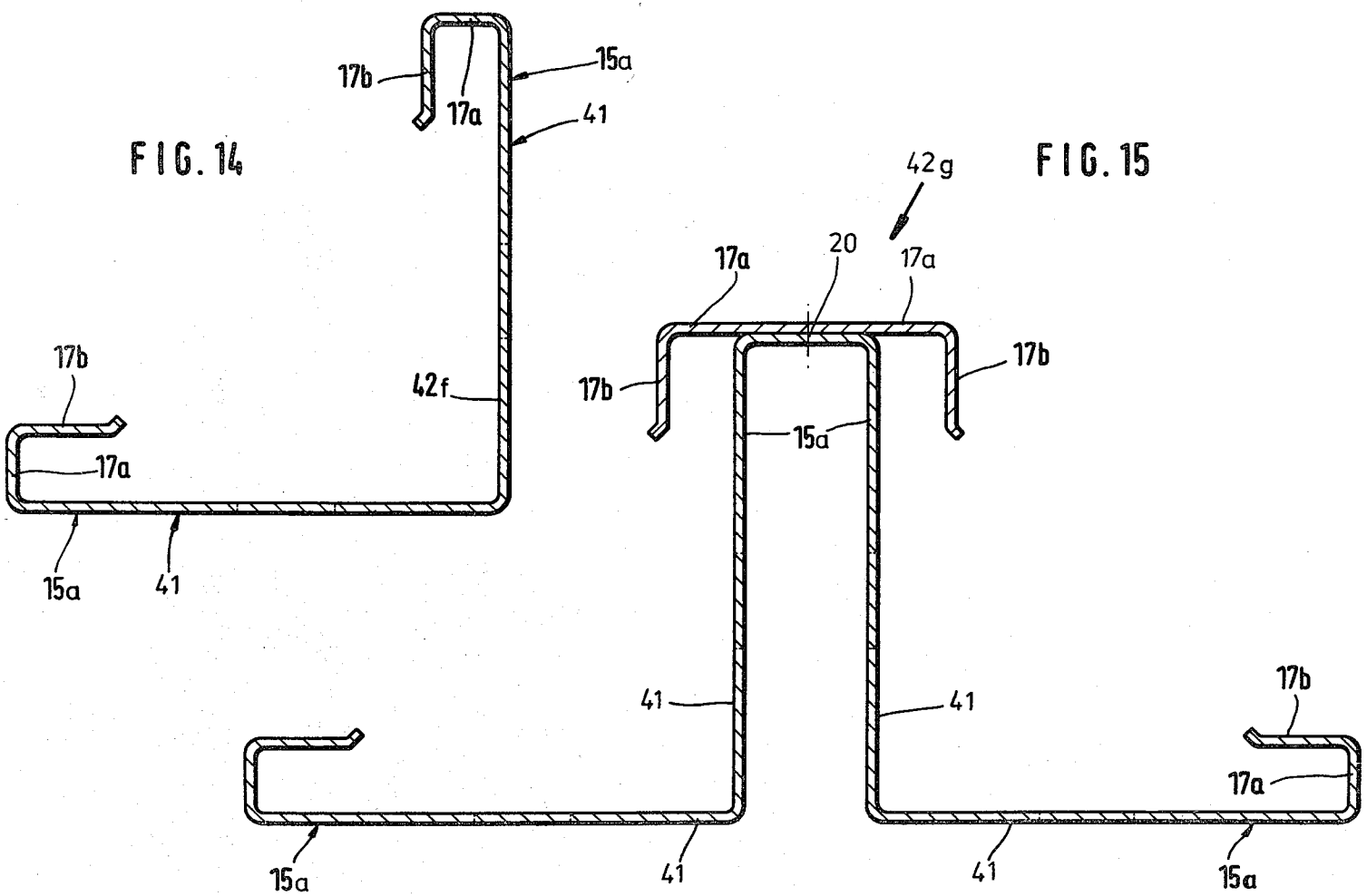
FIGS. 14, 15, and 16 are end views of further shell elements according to the invention.

FIG. 14 shows a shell element 42*f* whose main portions 41 extend at a right angle to each other, but whose edge flanges 15*a* are coplanar with the main portions 41. Inner and outer lips 17*a* and 17*b* extend from the outer edges of the edge flanges 15*a* as shown in FIGS. 1*a–1e*.

FIG. 15 shows a double element 42*g* that is actually two back-to-back elements 42*f*, but interconnected at a web 20 extending between the inner lips 17*a*.

Figure 16:
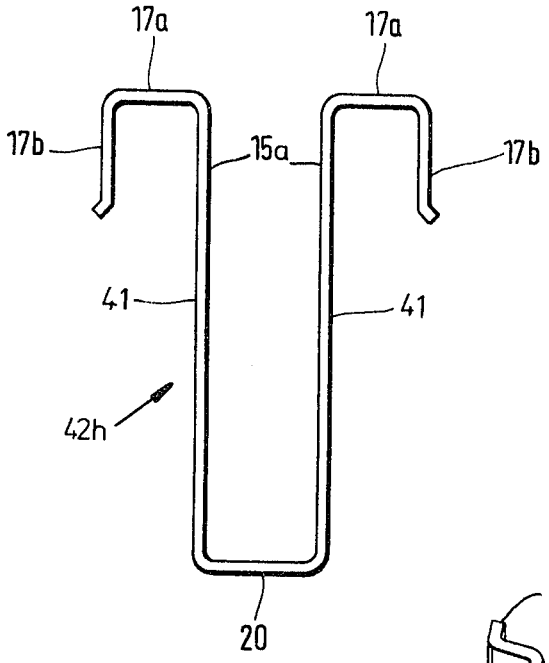
Figure 17:
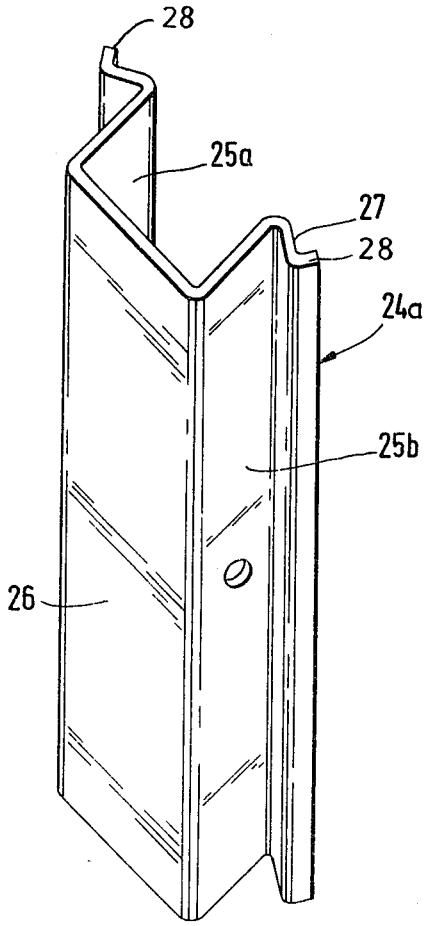
FIG. 17 is a perspective view of another clip according to this invention.

In FIG. 16 another element 42*h* is shown having two parallel main portions 41 interconnected by a bight portion or web 20, so that the two outer lips 17*b* extend parallel to each other and in the same direction from coplanar but spaced inner lips 17*a*.

Figure 18:
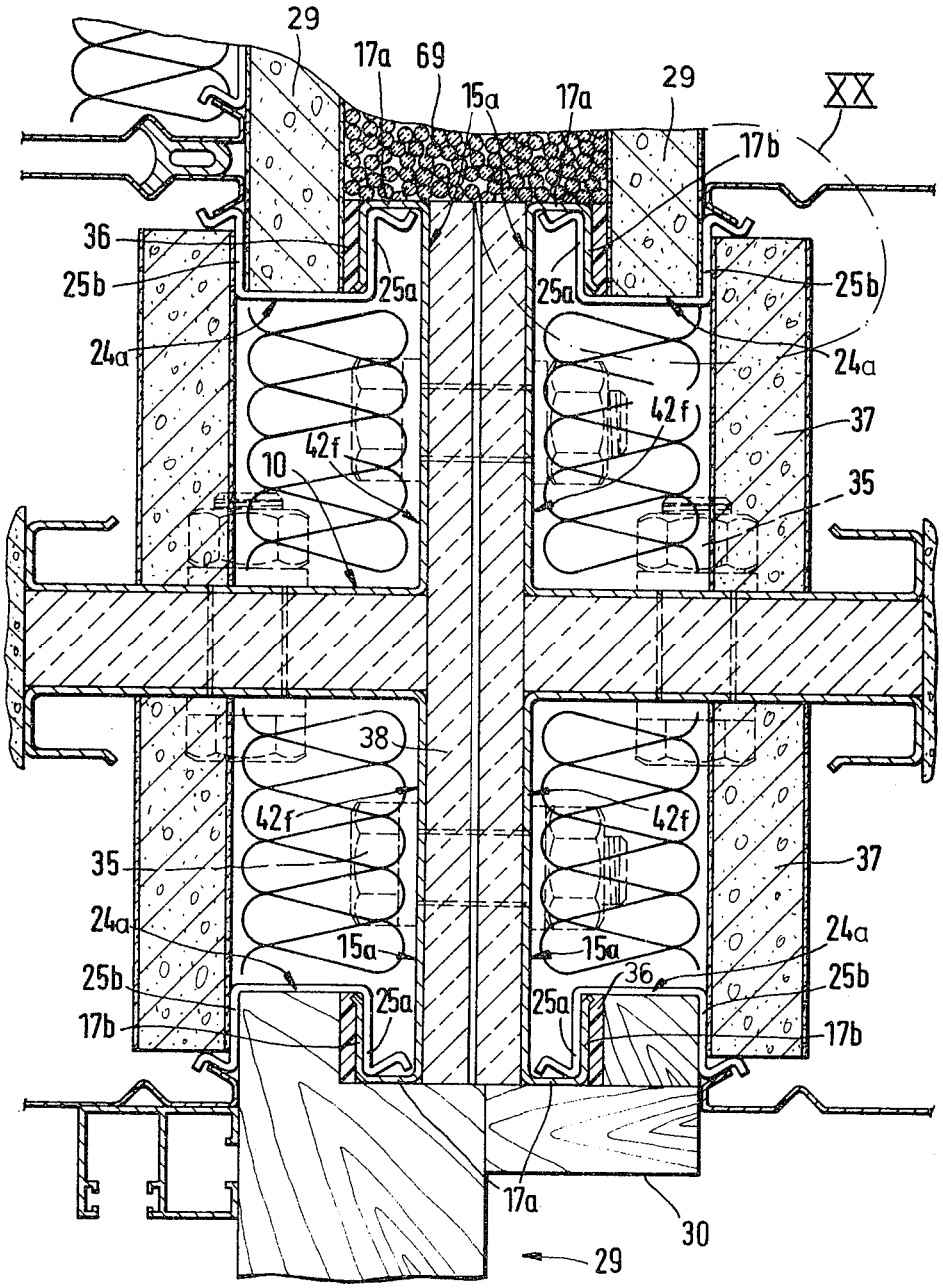
FIG. 18 is a section through another construction assembly according to this invention.

FIG. 18 shows another clip 24*a* formed in a manner similar to that of FIG. 2, but with bent-back retaining lips 27 having upturned outer edges 28. These clips 24*a*, like the clips 24, can either extend along the entire edge of the respective wall panel 29, or can be short and spaced along these edges.

Figure 19:
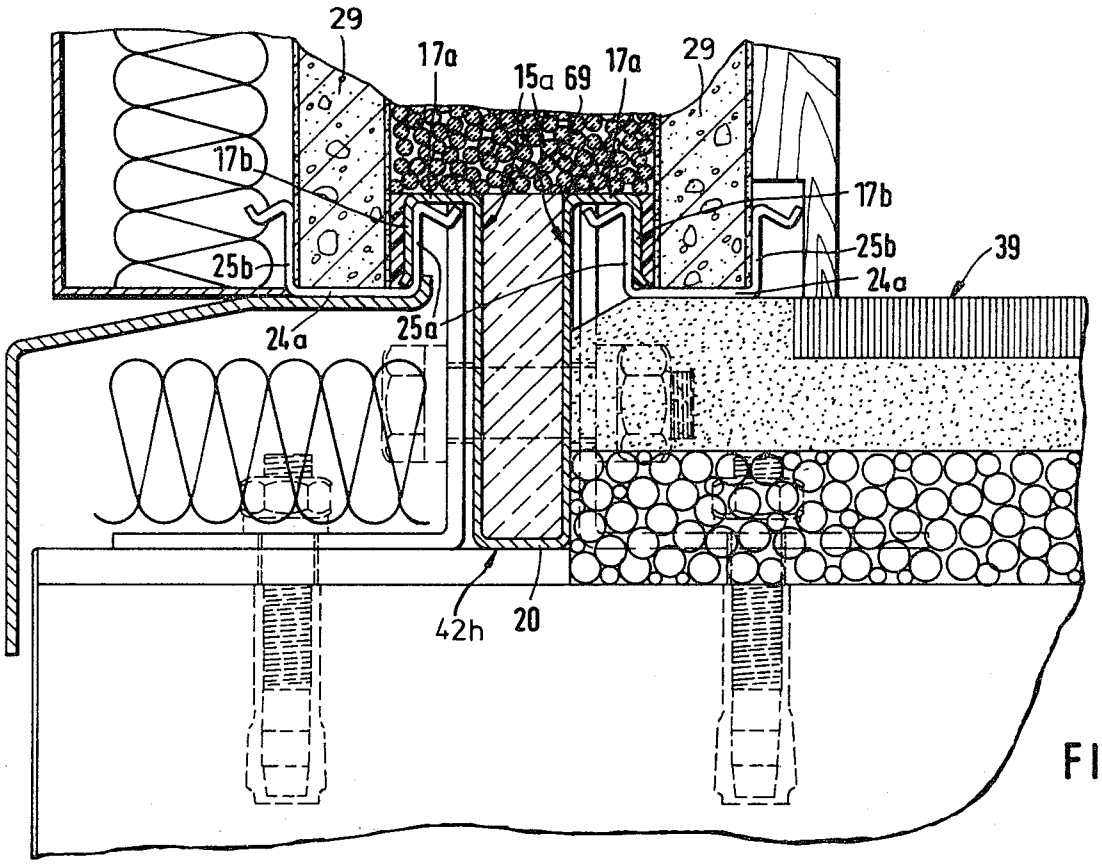
FIG. 19 is a vertical section through yet another construction assembly at floor level.

As seen in FIG. 19, the elements shown in FIGS. 15–18 are employed in substantially the same manner as the elements described with reference to FIGS. 1–14. The inner arm 25*a* of each clip 24*a* bears against the inside of the outer lip 17*b* of the respective shell element 42*h*, and the outer arm 25*b* bears in the opposite direction against the respective wall panel 29 which is received between the arms 25*a* and 25*b*. Once again the clip 24*a* is made of an elastically deformable material, such as a suitable polyamide, to elastically grip the edge of the respective panel 29.

Figure 20:
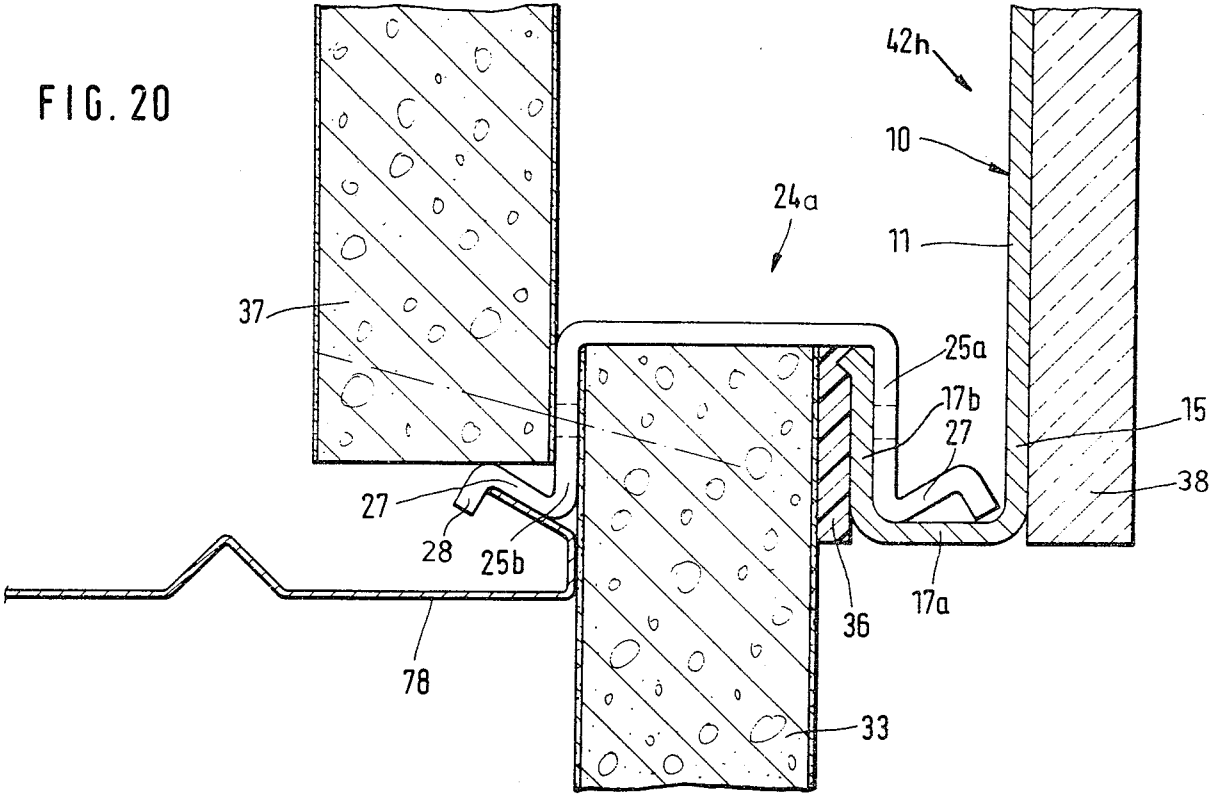
FIG. 20 is a large-scale view of the detail indicated at XX—XX in FIG. 18.

In FIG. 18 four separate elements 42*h* are bolted to two crossing boards 38 by means of bolts 35 to form a rigid star-shaped arrangement. Wall panels 29 are seated in the clips 24*a* as described above, and blocking boards 37 are then fitted in underneath the overturned edges 28 to rigidify the entire asssembly and make it virtually impossible for the outer arms 25*b* to be bent over to release these panels 29. Elastomeric seals 36 better shown in FIG. 20 are employed to prevent leakage at the joint.

Figure 21:
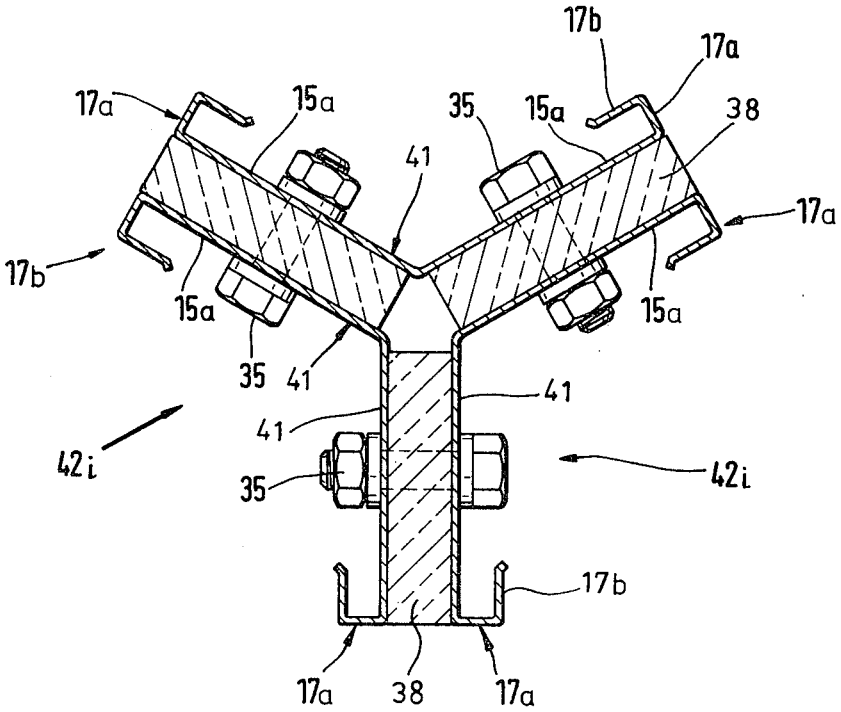
FIG. 21 is a horizontal section through a post according to this inventon.

Finally FIG. 21 shows the use of three elements 42*i* substantially identical to the elements 42*f*, except that their main portions 41 extend at an angle of 120° rather than 90° to each other. Three such elements 42*i* are secured by bolts 35 to boards 38 to make a star-shaped arrangement from which three cavity walls can easily be built.

Thus the construction assembly according to the instant invention allows partitions to be built with extreme easy and using virtually no screw or nail fasteners. The assembly can nonetheless incorporate relatively heavy wall panels.

I claim:

1. A building construction assembly comprising;

a plurality of vertical posts having flat integral and laterally projecting mounting flanges;

a plurality of horizontal members having integral and laterally projecting mounting flanges, a plurality of said flanges lying generally in a plane and annularly bounding an opening, the posts and members being of polygonal section and each being formed of a plurality of profile-section shell elements each having two such flanges, each post and member having a plurality of generally planar faces, the flanges each projecting perpendicularly from a respective face;

an inner lip extending generally parallel to the respective face from each of the flanges, each lip having an outer edge;

an outer lip extending substantially perpendicular to the respective face from the respective outer edge toward the respective element, the lips being integral with the respective shell elements;

at least one wall panel in said opening and having an outer edge lying against the outer lips of said flanges defining said opening; and a plurality of clips each having one arm engaging and bearing in one direction perpendicular to said plane on said panel and another arm engaging and bearing in the opposite direction on the outer lips of said flanges defining said opening, whereby said clips secure said wall panel to said members and posts.

2. The assembly defined in claim 1, further comprising respective resilient channels in which said lips are engaged.

3. The assembly defined in claim 2, wherein each of said channels is half of a double channel, whereby two wall panels can be clipped to adjacent parallel flanges in respective channels.

4. The assembly defined in claim 3 wherein two such flanges extend parallel to each other from the respective faces.

5. The assembly defined in claim 2 wherein said clips are of C-section and each have an outer arm forming a notch.

6. The assembly defined in claim 5, further comprising respective cover plates having overturned edges engageable in said notches and each overlying a respective shell element.

7. The assembly defined in claim 1, further comprising an insulating mass filling each of said posts within the respective shell elements.

8. The assembly defined in claim 1 wherein said shell elements are of metal.

* * * * *